United States Patent [19]

Jeffrey et al.

[11] Patent Number: 4,614,224

[45] Date of Patent: Sep. 30, 1986

[54] ALUMINUM ALLOY CAN STOCK PROCESS OF MANUFACTURE

[75] Inventors: Paul W. Jeffrey; John Sulzer, both of Kingston; Peter J. Ashley, Bath, all of Canada

[73] Assignee: Alcan International Limited, Montreal, Canada

[21] Appl. No.: 648,873

[22] Filed: Sep. 10, 1984

Related U.S. Application Data

[63] Continuation of Ser. No. 327,442, Dec. 4, 1981, abandoned.

[51] Int. Cl.[4] ..... B22D 11/06

[52] U.S. Cl. ..... 164/476; 164/432; 164/481; 164/485

[58] Field of Search ..... 148/2, 3; 164/417, 431, 164/432, 443, 476, 481, 485

[56] References Cited

U.S. PATENT DOCUMENTS 4,235,646 11/1980 Neufeld ..... 148/2

4,238,248 12/1980 Gyöngyös ..... 148/2

*Primary Examiner*—Nicholas P. Godici

*Assistant Examiner*—R. Seidel

*Attorney, Agent, or Firm*—Cooper, Dunham, Clark, Griffin & Moran

[57] ABSTRACT

Aluminum alloy sheet for use in drawn and ironed can bodies, having a content of 0.45–0.8% Mn, 1.1–2.2% Mg, 0.3–1.2% Fe, and 0.1–0.50% Si, produced by casting a continuous strip ingot of the alloy between chilled moving belts while maintaining a heat flux of at least about 40 cal./cm.$^2$/sec. through the belts such that the as-cast ingot has a cell size ranging from about 10–15 microns at its surfaces to about 23–30 microns at the center of its thickness, and reducing the ingot by rolling operations including cold rolling to can body stock gauge, the cold-rolled product having a maximum constituent particle size of about 2 microns at the surface and about 3–4 microns at the center.

5 Claims, 1 Drawing Figure

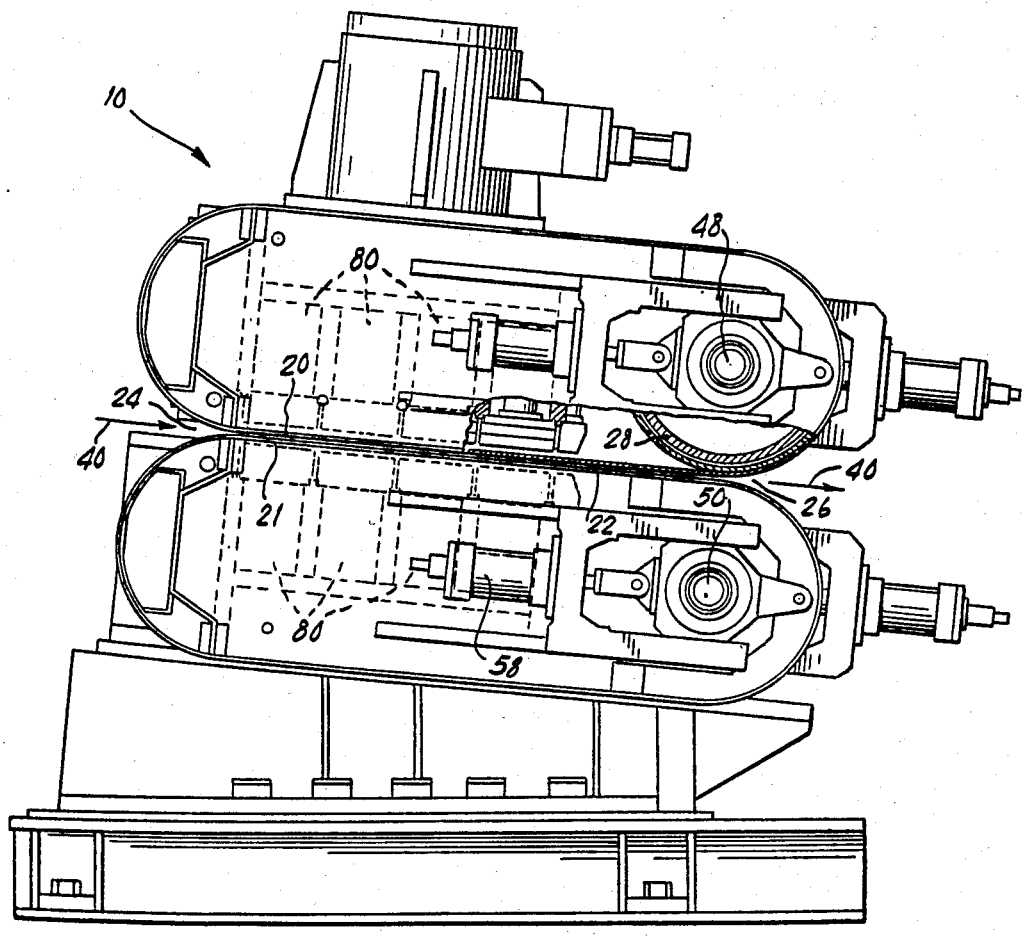
10
48
80
20
24
40
28
40
26
50
21
22
80
58

ALUMINUM ALLOY CAN STOCK PROCESS OF MANUFACTURE

This is a continuation of application Ser. No. 327,442, filed Dec. 4, 1981 now abandoned.

BACKGROUND OF THE INVENTION

This invention relates to a process for making aluminum alloy can stock, viz., aluminum alloy sheet for forming one-piece drawn and ironed can bodies, and to the product of such process.

Present-day metal cans as used for beverages such as soft drinks, beer and the like are commonly constituted of a seamless one-piece body (which includes the bottom end and cylindrical side wall of the can) and a top end bearing a ring or other opening device. The body is produced from a blank of cold-rolled aluminum alloy sheet (having a gauge, for example, of about 0.014 inch) by a now-conventional forming technique known as drawing and ironing, which involves drawing the blank into a cup and then passing it through a succession of dies to achieve the desired elongated cylindrical body configuration, with a side wall of reduced thickness relative to the bottom end. The top end is separately produced from another sheet aluminum alloy blank, by different but also conventional forming operations, and is secured around its circumference to the top edge of the side wall of the body to provide a complete can.

The severity of the forming procedure employed in producing a drawn-and-ironed can body as described above, and in particular the reduction in thickness of the can side wall (which must nevertheless be able to withstand the internal and external forces exerted on it in use), as well as the fact that the formed can is usually lacquered in an operation necessitating a strength-reducing exposure to heat, require a special combination of strength, formability, and tool wear properties in the alloy sheet from which the can body is made. Significant among these properties are ultimate tensile strength, yield strength, elongation, and earing. Attainment of the requisite combination of properties is dependent on alloy composition and on the processing conditions used to produce the sheet.

Heretofore, a conventional sheet for can body blanks has been constituted of the alloy having the Aluminum Association (AA) designation 3004, and has been produced from conventionally direct-chill-cast ingot up to 24 inches thick by scalping and homogenizing the ingot, and successively hot rolling and cold rolling to the desired final gauge; often an anneal treatment is used between the hot and cold rolling operations, with the annealing gauge so selected that the amount of cold reduction to final gauge after annealing is about 85%, thereby to provide can body blanks in H19 (extra hard) temper. Copending U.S. patent application Ser. No. 211,644 (now U.S. Pat. No. 4,318,755, issued Mar. 9, 1982), filed Dec. 1, 1980, by Paul W. Jeffrey (one of the applicants herein) and John C. Blade for Aluminum Alloy Can Stock and assigned to the same assignee as the present application, describes can body stock comprising aluminum alloy sheet at an intermediate temper and directly formable by drawing and ironing into a one-piece can body, containing 0.45–0.8% Mn and 1.5–2.2% Mg, with the following properties: ultimate tensile strength, at least about 38 thousand pounds/in.$^2$ (k.p.s.i.); yield strength, at least about 35 k.p.s.i.; elongation, at least about 1%; earing, not more than about 4%.

It will be understood that all composition percentages above and elsewhere herein are expressed as percentages by weight.

It would be desirable to utilize, e.g. in the manufacture of can body stock, so-called continuous strip casting techniques in place of conventional direct-chill casting of relatively thick ingots. Continuous strip casting is performed by supplying molten metal to a cavity defined between chilled, moving casting surfaces such as substantially parallel, extended planar runs of a pair of chilled endless metal belts, thereby to produce a thin (typically less than one inch thick) continuous cast strip. Belt-casting apparatus for such casting of strip is described, for example, in U.S. Pat. Nos. 4,061,177 and 4,061,178, the disclosures of which are incorporated herein by this reference. Advantages of continuous strip casting (as compared with direct chill casting of thick ingots) for production of sheet aluminum alloy products include enhanced efficiency and economy, especially in that the thinness of the as-cast strip significantly lessens the extent to which the cast body must be reduced by rolling to a desired sheet gauge. Heretofore, however, it has not been feasible to produce sheet for one-piece can bodies from belt-cast strip because AA 3004 alloy rolled from such strip to provide sheet of can body stock gauge at H19 temper does not possess satisfactory properties for commercial drawing and ironing into one-piece can bodies, owing to differences in work-hardening rate, earing, and required annealing temperature between strip-cast and direct chill-cast AA 3004 products.

U.S. Pat. No. 4,235,646 and No. 4,238,248 describe procedures for producing can body stock of various aluminum alloys from strip continuously cast in a casting machine, preferably of the type having a plurality of continuously moving chilling blocks arranged in two sets rotating in opposite senses to form a casting cavity to which the aluminum alloy is supplied for solidification in contact with the blocks. In these procedures, the cast strip is subjected to a holding period at elevated temperature before hot rolling. The patents further describe the cast strip as having a cell size or dendritic arm spacing preferablay of about 5–15 microns in the region of the strip surface and preferably of about 50–80 microns in the center of the strip thickness. After the holding period, the strip is initially reduced by hot rolling under conditions such that the temperature of the strip at the end of the hot rolling step is at least 280° C., and is then further reduced to can stock gauge by cold rolling.

SUMMARY OF THE INVENTION

The present invention is directed to improvements in a process for making can stock comprising cold-rolled sheet of an aluminum alloy consisting essentially of 0.45–0.8% Mn, 1.1–2.2% Mg, 0.3–1.2% Fe, 0.1–0.50% Si, up to 0.05% Ti, up to 0.15% each of Cu and Cr, other elements up to 0.05% each and up to 0.1% total, balance Al, the combined content of Mn+Mg being more than 1.9% and the combined content of Fe+Mn+Mg being at least about 2.5%, such process including the steps of continuously strip-casting an ingot of the alloy and rolling the ingot to produce the sheet. In particular, the invention contemplates improvements in this process which comprise performing the step of casting the ingot by continuously supplying the alloy in molten state to a casting space defined between facing extended planar surfaces of a pair of chilled, thermally conductive endless belts continuously moving so as to advance the supplied alloy through the casting space as a solidifying strip ingot in extended contact with the belt surfaces while maintaining a heat flux of at least about 40 cal./cm.$^2$/sec. through the belts, thereby to achieve controlled, rapid solidification, for producing an ingot which becomes fully solidified while in contact with the belt surfaces within the casting space and which as cast has a cell size of about 10–15 microns at its surfaces and of about 23–30 microns at the center of its thickness.

The rolling step includes at least a final cold-rolling operation for producing cold-rolled aluminum alloy sheet directly formable, by drawing and ironing, into a one-piece can body. As used herein, the term "directly formable" means sheet characterized by a gauge and properties such that it can be cut into blanks and drawn and ironed without any further reduction or thermal treatment. Further in accordance with the invention, the conditions of the aforementioned casting step are such as to provide, in the final cold-rolled sheet, a constituent particle size of not more than about 2 microns at its surfaces and not more than about 4 microns at the center of its thickness.

Preferably, in the casting step, the heat flux through the belts is between about 40 and about 90 cal./cm.$^2$/sec. It is especially preferred to perform the casting step in a twin-belt casting machine of the type shown and described in the aforementioned U.S. Pat. No. 4,061,177 and No. 4,061,178, wherein the casting space is defined between runs of the belts each having a surface facing away from the casting space, and wherein the casting step comprises chilling the belts by direct impingement of coolant on the last-mentioned surfaces of the belt runs.

In a further aspect, the invention additionally embraces can stock produced by the foregoing process.

The production of sheet in accordance with the invention provides can stock that is fully satisfactory for use in making drawn and ironed can bodies, and realizes the benefits of continuous strip casting, indeed with special advantages. In particular, the defined casting step affords features of microstructure including a difference between center and surface cell size of beneficially reduced magnitude in the as-cast strip, and an advantageously smaller constituent size in the center of the final cold-rolled sheet, i.e. as compared to the microstructure attained with previously known techniques utilizing strip casting in the manufacture of can body stock. These features of micro-structure are desirable from the standpoint of product properties, and, very importantly, they enable can body stock to be produced from continuously cast strip without the necessity of providing special temperature conditions after the casting and/or hot-rolling steps.

Further features and advantages of the invention will be apparent from the detailed description hereinbelow set forth, together with the accompanying drawing.

BRIEF DESCRIPTION OF THE DRAWING

The single FIGURE is a simplified side elevational view of the casting apparatus suitable for use in the practice of the process of the present invention.

DETAILED DESCRIPTION

Referring to the drawing, there is shown a twin-belt casting machine 10 of the type described in the aforementioned U.S. Pat. No. 4,061,177 and No. 4,061,178 for casting a more or less wide continuous strip of an aluminum alloy. This machine includes a pair of resiliently flexible, heat-conducting endless belts 20 and 21, e.g. metal belts, arranged to be continuously drawn (in rotational senses opposite to each other) through a region in which they have runs substantially parallel to each other, with some degree of convergence. The runs of the two belts in the last-mentioned region have facing, extended planar surfaces which cooperatively define a casting space 22. Molten metal is continuously supplied into this casting space while the last-mentioned runs of the belts are chilled at their reverse faces, i.e. the surfaces facing away from the casting space, by direct impingement of coolant liquid on the latter belt surfaces.

In the illustrated apparatus, the path of the metal being cast is substantially horizontal with a small degree of downward slope from entrance to exit of the casting space. Thus the upper and lower endless belts 20 and 21 are arranged so that their facing runs are substantially parallel to each other through the region where they define the casting space 22 from its entrance 24 to its exit 26, the belts being guided through looped return paths between the localities 26 and 24. Suitable means (including a driving pulley 28 for the upper belt and a similar driving pulley, not shown, for the lower belt) are provided for continuously advancing both belts. The path of metal through the casting apparatus is indicated by arrows 40. The belts themselves are constructed in appropriate manner for casting apparatus of this type, being advantageously of metal, e.g. suitably flexible but stiffly resilient steel of appropriately high strength and of such nature that it can be sufficiently tensioned without inelastic yield. The apparatus as shown includes fluid cylinder means for positionally adjusting the shafts 48 and 50 of the driving pulleys, such means being indicated at 58.

Molten metal is supplied to the casting space 22 by a suitable launder or trough (not shown) which is disposed at the entrance and 24 of the casting space. As is usual in belt-casting machines, the apparatus is provided with edge dams (not shown), e.g. of conventional character, at each side so as to complete the enclosure of the casting space 22 at its edges. Suitable means are provided for cooling and supporting the belts 20 and 21 along the length of the casting space 22, such means being represented schematically at 80 and including nozzles or the like (not shown) for directing coolant water over the surfaces of the belts facing away from the casting space, all as fully described in the aforementioned U.S. Pat. No. 4,061,177 and No. 4,061,178. It will be understood that in the operation of the apparatus, molten metal supplied to the aforementioned inlet launder feeds against the belts 20 and 21 converging in their curved paths to the casting space entrance 24; the metal enters that space as a substantially parallel-faced liquid body, and in its advance through the casting space 22 to the exit end 26 (such advance being effected by the continuous motion of the belts), the metal being cast becomes progressively solidified from its upper and lower faces inward, heat from the metal being transferred through the belts and removed therefrom by the coolant supplied by means 80; throughout the extended length of the casting zone, the metal being cast is in contact with the surfaces of the belts and becomes fully solidified before reaching the exit end of the casting space, emerging from the exit end as a continuous, solid, cast strip.

In currently preferred embodiments of the present invention, the casting step is performed in a casting machine of the above-described type, having the further features set forth in more detail in U.S. Pat. No. 4,061,177 and No. 4,061,178, such apparatus being found to be especially effective in achieving satisfactory performance of the special casting step of this process.

Within the broad limits of composition hereinabove set forth, preferred alloys for the practice of the invention include those described in the aforementioned copending U.S. patent application Ser. No. 211,644, and, in particular, an alloy composition consisting essentially of 0.5–0.8% Mn, 1.5–2.2% Mg, 0.1–0.50% Si, 0.3–1.0% Fe, up to 0.15% Cu, 0.015–0.025% Ti, other elements less than 0.05% each, balance Al, with a combined content of Mn and Mg of not less than about 2.2%. A presently especially preferred composition consists essentially of the following:

| | Range or Maximum (%) | Nominal (%) |
|---|---|---|
| Mn | 0.65–0.75 | 0.70 |
| Mg | 1.70–1.90 | 1.80 |
| Si | 0.12–0.18 | 0.15 |
| Fe | 0.45–0.60 | 0.50 |
| Cu | 0.06–0.10 | 0.08 |
| Ti | 0.015–0.025 | 0.020 |
| other elements (total) | 0.10 | |
| Al | balance | |

Further in accordance with presently preferred practice, to produce can body stock with the process of the invention, an alloy having a composition as just described is prepared, and suitably degassed and filtered to ensure a high quality of metal being supplied to the casting machine. This alloy is continuously cast into strip having a thickness of ½ inch in a twin-belt casting machine of the above-described type using steel casting belts e.g. 0.040 inch thick, so arranged that their surfaces defining the casting space converge 0.010 inch over a casting space length of 40 inches. The belts have surfaces shot-blasted to a roughness of 210 microinches RMS and subsequently brushed with a silicon-carbide-loaded brush for 14–20 belt revolutions, i.e. prior to casting. To these belts there is applied a parting layer comprising polybutenes with 25% lecithin and sufficient freon to make the parting layer composition satisfactorily sprayable. The amount of parting layer used is on the order of 0.1 to 0.2 mg/cm.$^2$ of belt area as a precoat with uniform recoating provided by continuous spraying onto the belts during casting; the amount of respray is only a fraction of the precoat, and is adjusted to maintain a minimum heat flux through the belts of 40–60 cal./cm.$^2$/sec. Preferably, the heat flux is maintained at a value of 70–80 cal./cm.$^2$/sec. To avoid belt distortion, the heat flux is kept below an upper limit of 85–90 cal./cm.$^2$/sec. During casting, the belts are brushed continuously with rotating brushes to maintain uniformity of oil distribution over the belt surface.

The casting speed, for a ½-inch-thick ingot, is preferably in a range of 20–30 feet per minute and is adjusted as indicated by ingot surface appearance and to achieve a desired ingot average exit temperature from the casting machine. An exit temperature of 450°–480° C. is preferred.

The as-cast ingot is fed directly from the casting machine into a hot rolling mill at an ingoing temperature of between 380° and 450° C.; it is typically subjected to a total hot reduction of about 72 to about 82%, leaving the hot mill at an exit temperature of about 150°–200° C., and is then coiled.

Thereafter, the hot-rolled coil (herein termed "reroll") is cold rolled to a final can body stock gauge, e.g. a final gauge of 0.013–0.015 inch, with an anneal performed at a gauge such that the amount of coil reduction after annealing (i.e. to reduce the coil from the annealing gauge to the final can body stock gauge) is between 40 and 65% using a batch anneal or 30–65% using a flash anneal, thereby to provide can body stock at an intermediate temper. In a typical example of half-inch cast strip hot-rolled to a gauge of 0.090 inch, the reroll is reduced from the latter gauge to 0.040 inch in an initial cold-rolling operation, then batch-annealed for two hours at 400°–420° C., and then further cold rolled to a final gauge of 0.015 inch.

The can body stock thus produced can be cut into suitable blanks and formed directly, by drawing and ironing, into one-piece can bodies. Properties of the can body stock, i.e. in final cold-rolled gauge, include an ultimate tensile strength of at least about 38 k.p.s.i. (but not more than about 45 k.p.s.i.), yield strength of at least about 35 k.p.s.i. (but not more than about 44 k.p.s.i.), at least about 1% elongation, and not more than about 4% earing.

Referring further to the above-described strip-casting step of the present process, a relatively high heat transfer rate for the duration of the solidification is achieved in the specified casting machine by maintenance of a high heat transfer rate to the coolant water through the use of thin steel belts and high water velocities against the reverse surfaces of the belts, together with the convergence of the casting surfaces of the belts which assures good contact of the belts with the solidifying strip ingot throughout the solidification interval. This desired high heat transfer rate is controlled at the belt/ingot interfaces by the use of a liquid oil formulation and a randomly rough controlled texture of the belt surfaces.

Uniformity of oil (parting layer) over the belt surfaces is extremely important to satisfactory performance of the casting step. Spray guns, reciprocating at controlled speeds and synchronized with the belt motion, are currently preferred for application of the parting layer to provide the requisite macro-uniformity of the parting layer, while the aforementioned rotating brushes maintain micro-uniformity of parting layer distribution. Thereby, there is achieved a desired consistency of metallurgical ingot quality during continuous strip casting. Deviations of heat fluxes from area to area can lead to some variations of ingot structure and surface blemishes as the slower solidifying areas exhibit coarser cell size, grain size, and porosity; the porosity results from feed metal being drawn from these areas as a result of shrinkage contraction in higher heat transfer areas, and must be avoided. The described controlled but high heat transfer rates, and controlled belt proximity and flatness relative to the solidifying strip ingot surface, minimize the coarsening tendencies of ingot structure from ingot surface to ingot center.

This minimization of coarsening tendencies is evident from a comparison of measured dendritic cell size (or dendrite arm spacing) in the as-cast strip ingot of the present process, with known or reported values for conventional, 20-inch-thick-direct-chill-cast ingot and strip ingot produced on a block casting machine:

| | Average Dendrite Arm Spacing (microns) | |
|---|---|---|
| | Ingot Surface | Ingot Center |
| Conventional D.C. Ingot | 30 | 70 or more |
| Present Ingot | 10–15 | 23–30 |
| Block-Caster Ingot | 5–15 (preferred) | 50–80 (preferred) |

and, further, from measurements of the variation of dendritic cell size through the thickness of a ½-inch-thick as-cast strip ingot of the above-described preferred alloy, cast in accordance with the casting step of the present process, viz.:

| Distance from Ingot Top Surface (% of thickness) | Average Dendritic Cell Size (microns) |
|---|---|
| 0.5 | 11 |
| 13.0 | 19 |
| 35.0 | 17 |
| 49.0 | 24 |

The fine cell size of the alpha aluminum phase, attained in the practice of the present invention, results in a fine distribution of soluble and insoluble eutectic phases, which in turn provides advantageously fine constituent particle sizes in the rolled sheet products, as compared with sheet products obtained from conventional direct-chill-cast ingot:

| | Size of Largest Constituent Particles (microns) | |
|---|---|---|
| Sheet Produced From: | Sheet Surface | Sheet Center |
| Conventional D.C. Ingot | 10 | 25–30 |
| Present Ingot | 2 | 3–4 |

The very fine constituent size achieved with the present process affords desirably improved formability and mechanical properties.

By way of further illustration of the invention, reference may be made to the following specific example:

Two alloys were prepared respectively having the following percentage contents of alloying elements (balance essentially aluminum):

| | Alloy I | Alloy II |
|---|---|---|
| Mn | 1.20 | 0.66 |
| Mg | 0.99 | 1.60 |
| Si | 0.17 | 0.13 |
| Fe | 0.53 | 0.51 |
| Cu | 0.07 | 0.09 |

-continued

| | Alloy I | Alloy II |
|---|---|---|
| Ti | 0.010 | 0.012 |

Alloy I was an AA 3004-type alloy, and alloy II had a composition in accordance with the present invention.

Each alloy was continuously cast as ½-inch-thick strip on a belt caster of the type referred to above, and rolled to can body stock gauge. One coil of each alloy was homogenized for 8 hours at 575° C. (at 0.090 inch gauge for alloy I and at 0.060 inch gauge for alloy II) while another coil of each alloy was simply annealed for 2 hours at 470° C. (alloy I) or 440° C. (Alloy II).

Pertinent treatments and properties of the coils of can body stock gauge sheet thus produced are as follows:

| | | Longitudinal Tensile Properties | | | | | |
|---|---|---|---|---|---|---|---|
| Alloy | Heat Treatment* | Final Cold Work (%) | Ult. Tensile Strength (k.p.s.i.) | Yield Strength (k.p.s.i.) | Elongation (%) | 45° Earing (%) | Buckle Pressure** (p.s.i.) |
| I | A | 63 | 41.0 | 39.4 | 2.3 | 3.5 | 92 |
| | H | 83 | 42.7 | 41.9 | 1.8 | 3.7 | 96 |
| II | A | 50 | 39.5 | 36.1 | 4.0 | 1.5 | 92 |
| | H | 75 | 41.3 | 39.9 | 2.8 | 3.9 | 94 |

*A —annealed
H —homogenized
**adjusted for gauge

About 60 one-piece can bodies were formed, by drawing and ironing, from each coil, with no scoring problems. The coil of alloy II with 50% reduction after annealing, demonstrated preferred properties, although its yield strength was below that typically shown by conventional can stock materials, the buckle pressure satisfactorily exceeded the minimum standard of 90 p.s.i. generally required by can manufacturers.

The remaining three coils exhibited unduly high earing in the drawing-and-ironing operation, as would be expected from the earing levels recorded above.

The batch annealing temperature of 470° C. required by Alloy I led to unacceptably high levels of oxidation and staining and the problem cannot be avoided by flash-annealing at economically acceptable rates.

Although the annealing temperature of 440° C. applied to Alloy II leads to barely acceptable levels of oxidation and staining, it has been found possible to lower the annealing temperature for Alloy II to 410°–420° C., at which the staining and oxidation is greatly reduced without adverse effects on the earing characteristics. Large scale trials have been carried out successfully on sheet of a composition similar to Alloy II (but having a Mg content of 1.8%) and annealed at 410°–420° C.

It is to be understood that the invention is not limited to the features and embodiments hereinabove specifically set forth, but may be carried out in other ways without departure from its spirit.

We claim:

1. In a process for making can stock comprising cold-rolled sheet of an aluminum alloy consisting essentially of 0.45–0.8% Mn, 1.1–2.2% Mg, 0.3–1.2% Fe, 0.1–0.50% Si, up to 0.05% Ti, up to 0.15% each of Cu and Cr, other elements up to 0.05% each and up to 0.1% total, balance Al, the combined content of Mn+Mg being more than 1.9% and the combined content of Fe+Mn+Mg being at least about 2.5%, said process including the steps of continuously strip-casting an ingot of said alloy and rolling said ingot to produce the sheet, the improvement which comprises performing the step of casting said ingot by continuously supplying the alloy in molten state to a casting space defined between facing extended planar surfaces of a pair of chilled, thermally conductive endless belts continuously moving so as to advance the supplied alloy through the casting space as a solidifying strip ingot in extended contact with said belt surfaces while maintaining a constant heat flux of at least about 40 cal./cm.$^2$/sec. through the belts, for producing an ingot which becomes fully solidified while in contact with the belt surfaces within the casting space and which as cast has a cell size of about 10–15 microns at its surfaces and of about 23–30 microns at the center of its thickness.

2. A process for making can stock comprising cold-rolled aluminum alloy sheet directly formable, by drawing and ironing, into a one-piece can body, said process comprising (a) continuously strip-casting an ingot of an aluminum alloy consisting essentially of 0.45–0.8% Mn, 1.1–2.2% Mg, 0.3–1.2% Fe, 0.1–0.50% Si, up to 0.05% Ti, up to 0.15% each of Cu and Cr, other elements up to 0.05% each and up to 0.1% total, balance Al, the combined content of Mn+Mg being more than 1.9% and the combined content of Fe+Mn+Mg being at least about 2.5%; and (b) subjecting said ingot to rolling, including at least a final cold-rolling operation, to produce said sheet;

wherein the improvement comprises:

(c) performing the step of casting said ingot by continuously supplying the alloy in molten state to a casting space defined between facing extended planar surfaces of a pair of chilled, thermally conductive endless belts continuously moving so as to advance the supplied alloy through the casting space as a solidifying strip ingot in extended contact with said belt surfaces while maintaining a constant heat flux of at least about 40 cal./cm.$^2$/sec. through the belts, for producing an ingot which becomes fully solidified while in contact with the belt surfaces within the casting space and which as cast has a cell size of about 10–15 microns at its surfaces and of about 23–30 microns at the center of its thickness, and for providing in said cold-rolled sheet a constituent particle size of not more than about 2 microns at its surfaces and not more than about 4 microns at the center of its thickness.

3. A process according to claim 1 or 2 wherein the casting step comprises maintaining a constant heat flux of between about 40 and about 90 cal./cm.$^2$/sec. through the belts.

4. A process according to claim 1 or 2 wherein the casting space is defined between runs of the belts each having a surface facing away from the casting space, and wherein the casting step comprises chilling the belts by direct impingement of coolant on the last-mentioned surfaces of said belt runs.

5. A process according to claim 4 wherein said facing planar surfaces converge within the casting space for providing extended contact of the solidifying ingot.

* * * * *